United States Patent [19]

Meyer et al.

[11] 4,439,200

[45] Mar. 27, 1984

[54] SINGLE STAGE HIGH PRESSURE CENTRIFUGAL SLURRY PUMP

[75] Inventors: John W. Meyer, Palo Alto; John H. Bonin, Sunnyvale; Arnold D. Daniel, Alameda, all of Calif.

[73] Assignee: Lockheed Missiles & Space Co., Inc., Sunnyvale, Calif.

[21] Appl. No.: 330,469

[22] Filed: Dec. 14, 1981

[51] Int. Cl.[3] ..... B65G 53/30

[52] U.S. Cl. ..... 406/99; 414/217; 417/900

[58] Field of Search ..... 415/116, 117; 60/39.46 S; 406/14, 93, 94, 71, 98, 99, 52; 414/217; 239/423, 433; 417/71, 900

[56] References Cited

U.S. PATENT DOCUMENTS

| | | | |
|---|---|---|---|
| 2,814,531 | 11/1957 | Murray | 406/106 |
| 3,182,825 | 5/1965 | Zellerhoff | 414/217 |
| 4,076,450 | 2/1978 | Ross | 417/900 X |

*Primary Examiner*—Edward K. Look
*Attorney, Agent, or Firm*—H. Donald Volk

[57] ABSTRACT

Apparatus is shown for feeding a slurry to a pressurized housing. An impeller that includes radial passages is mounted in the loose fitting housing. The impeller hub is connected to a drive means and a slurry supply means which extends through the housing. Pressured gas is fed into the housing for substantially enveloping the impeller in a bubble of gas.

2 Claims, 9 Drawing Figures

14
36
28
20
52
10
12
18
40
16
DRIVE MOTOR
42
46
44
38
44
22
52
26
29
26
24
30
32
34
TO PROCESS 62
60
12
26
50
28
20
18
48
10
54

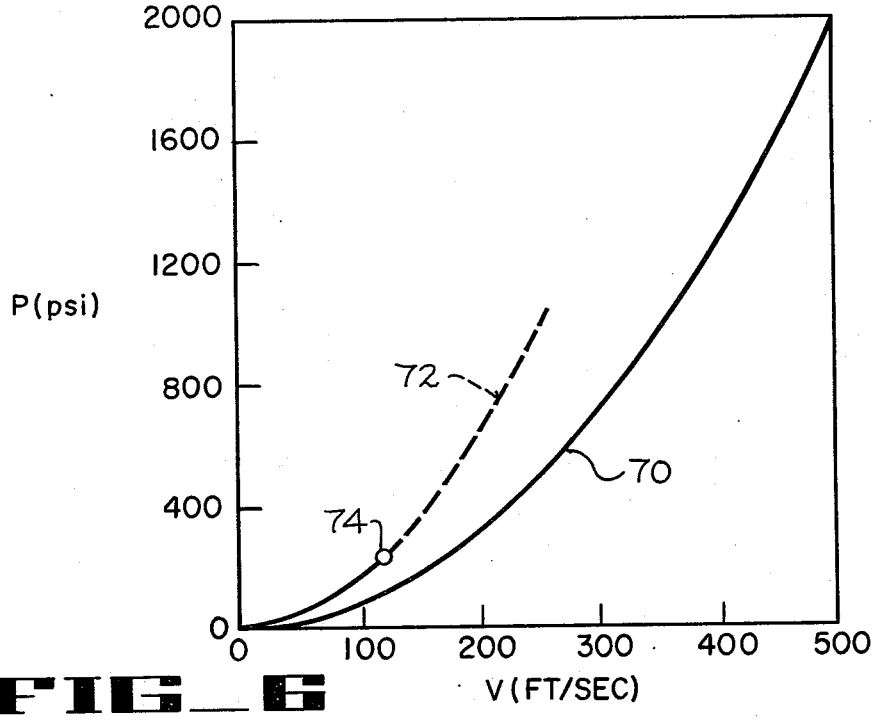
FIG_6
FIG_7
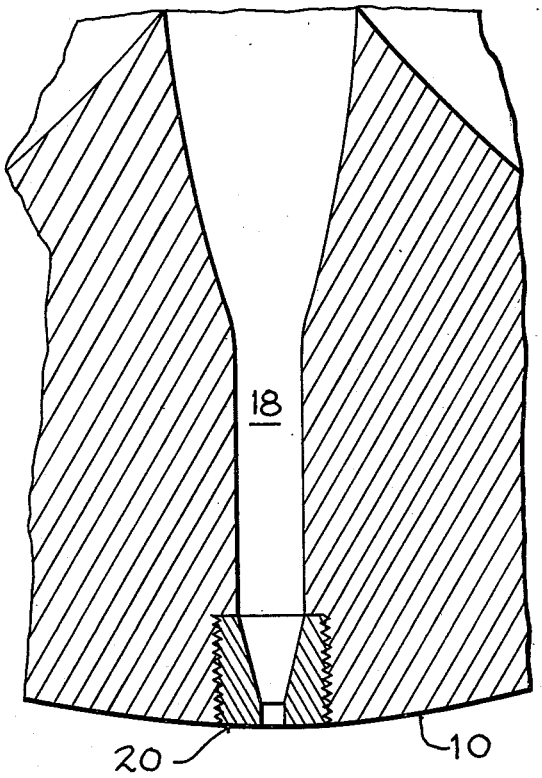

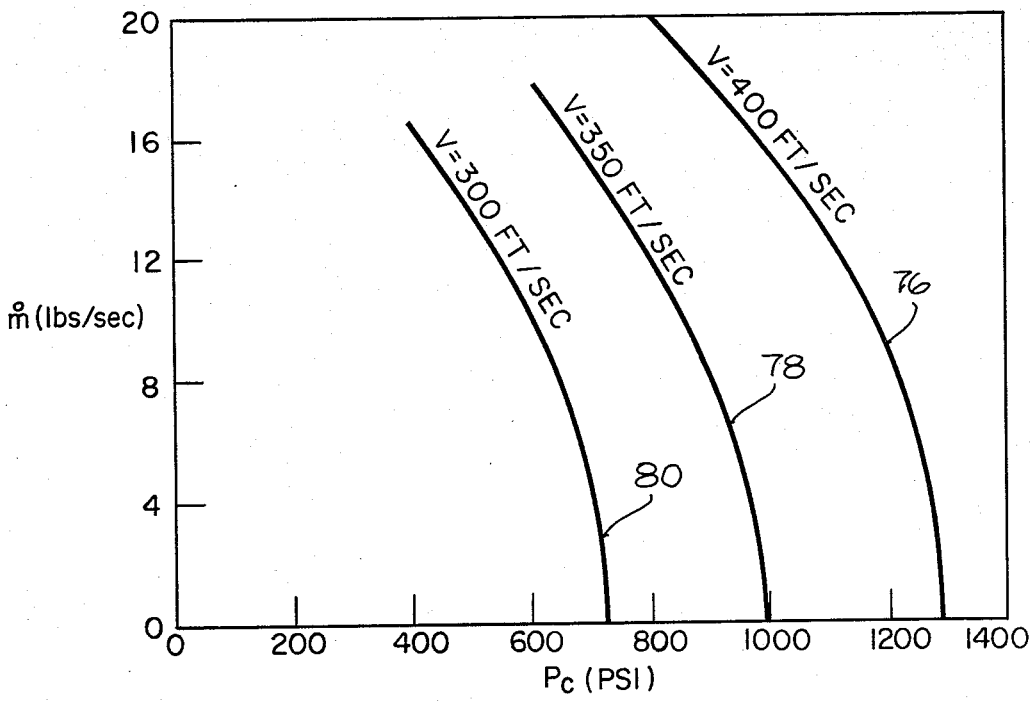
FIG_8
FIG_9
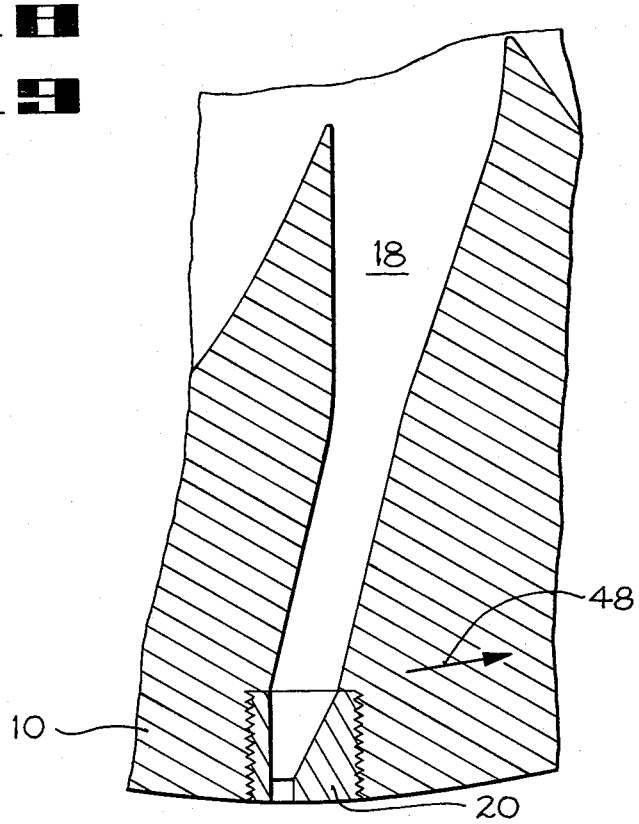

SINGLE STAGE HIGH PRESSURE CENTRIFUGAL SLURRY PUMP

TECHNICAL FIELD

The Government has rights in this invention pursuant to Contract No. EX76-C-01-1792 awarded by the Department of Energy. This invention relates to a single stage high pressure centrifugal slurry pump and more particularly to such devices in which a gas bubble is maintained surrounding the rotor.

BACKGROUND ART

Centrifugal pumps are frequently used to pump slurries consisting of a finely divided solid suspended in a liquid. Due to the erosive action of the pumped slurry on the tips of the impeller, it is necessary to limit the operation speed of the centrifugal pump. In practice, it has been found that the speed of the impeller tip must be limited to approximately 120 feet per second. This limitation on the tip speed limits such conventional centrifugal pumps to low pressure applications. Also, when the conventional centrifugal pump is used to pump slurries containing abrasive material, such as coal, a great deal of wear occurs in the periphery of the rotor, and necessitates the replacement of the entire pump, or if the periphery of the impeller is replaceable as pointed out in U.S. Pat. No. 4,076,450, only the worn parts need to be replaced. However, such replacement is still required too frequently and the lost time and labor for repair add considerably to the expense of operating such pumps.

Another wear problem in centrifugal pumps of the volute type is bearing and packing wear. In such pumps the radial thrust is only uniform at the optimum design speed of the pump. At lower speeds, particularly when the pump is started or is stopped, the radial thrust is non-uniform. Due to this non-uniform thrust condition attempts have been made to stiffen the support assembly and to compensate for the effect of the thrust by complex bushing designs. See U.S. Pat. No. 4,224,008 in this regard.

For higher pressure, a number of centrifugal pumps can be cascaded. U.S. Pat. No. 4,239,422 shows such an arrangement. Since failure of any single pump in such an arrangement is possible and would cause the total system to fail, such a system has low reliability. To improve reliability, it would be preferable to use a single pump instead of the cascaded centrifugal pumps, but this is not possible with the conventional centrifugal pump.

Positive displacement type pumps, such as reciprocating plunger pumps, can be used in high head applications, but due to abrasion wear, are unsatisfactory with high abrasive slurries. Such high abrasive slurries cause unacceptable rapid wear on check valves and packings.

U.S. patent application Ser. Nos. 188,047, 032,651, 199,861, and 036,843 disclose apparatus for pumping a dry pulverized material in a high head situation. Although these disclosed pumps are adequate for pumping a dry material, they are not suited for pumping slurry mixtures.

DISCLOSURE OF INVENTION

According to the present invention, a gas bubble is maintained surrounding the rotor.

Further understanding of the present invention can be had by appreciating the problem of rotor erosion and the fact that the shape of the rotor and the inclusion of the gas bubble markedly reducing such erosion.

In accordance with the present invention, the pump impeller of the centrifugal pump runs in a loose-fitting casing which is filled with a compressed gas rather than the pumped medium.

Such a device will have application in any of a number of industrial processes involving vessels which operate at elevated gas or liquid pressures that require solid material slurries involved in the process to be pumped into them from a low or atmospheric pressure environment. A prominent example of such a process is coal liquifaction, which utilizes coal reactor vessels operating at 50 to 200 times atmospheric pressure, depending on the particular process. A slurry consisting of finely ground coal suspended in either water or in a process derived oil is the feedstock which must be injected into these reactor vessels.

The rotor/impeller is roughly a disk shaped wheel with entirely internal, approximately radial, channels through which the slurry flows. The fluid pressure rise takes place only in these internal channels in the rotor. The slurry is discharged into the casing through nozzles in the rotor rim which are attached to and mounted internal to the distal end of the rotor channels.

A gas bubble is maintained surrounding the rotor so that the rotor skin drag is very low in comparison to the drag that would manifest if the same impeller was running in a liquid. The bubble gas is not consumed in the process and gas is only fed in to make up for minor amounts lost by dissolution in the slurry.

BRIEF DESCRIPTION OF DRAWINGS

FIG. 6 shows the ideal head produced by the present invention in comparison to conventional centrifugal pumps.

FIG. 7 is a broken away sectional view of the slurry passage in the impeller of the present invention.

FIG. 8 gives example pump characteristic curves for the present invention.

FIG. 9 is a broken away sectional view of a slurry passage swept back with respect to the rotation direction.

BEST MODE OF CARRYING OUT THE INVENTION

Figure 1:
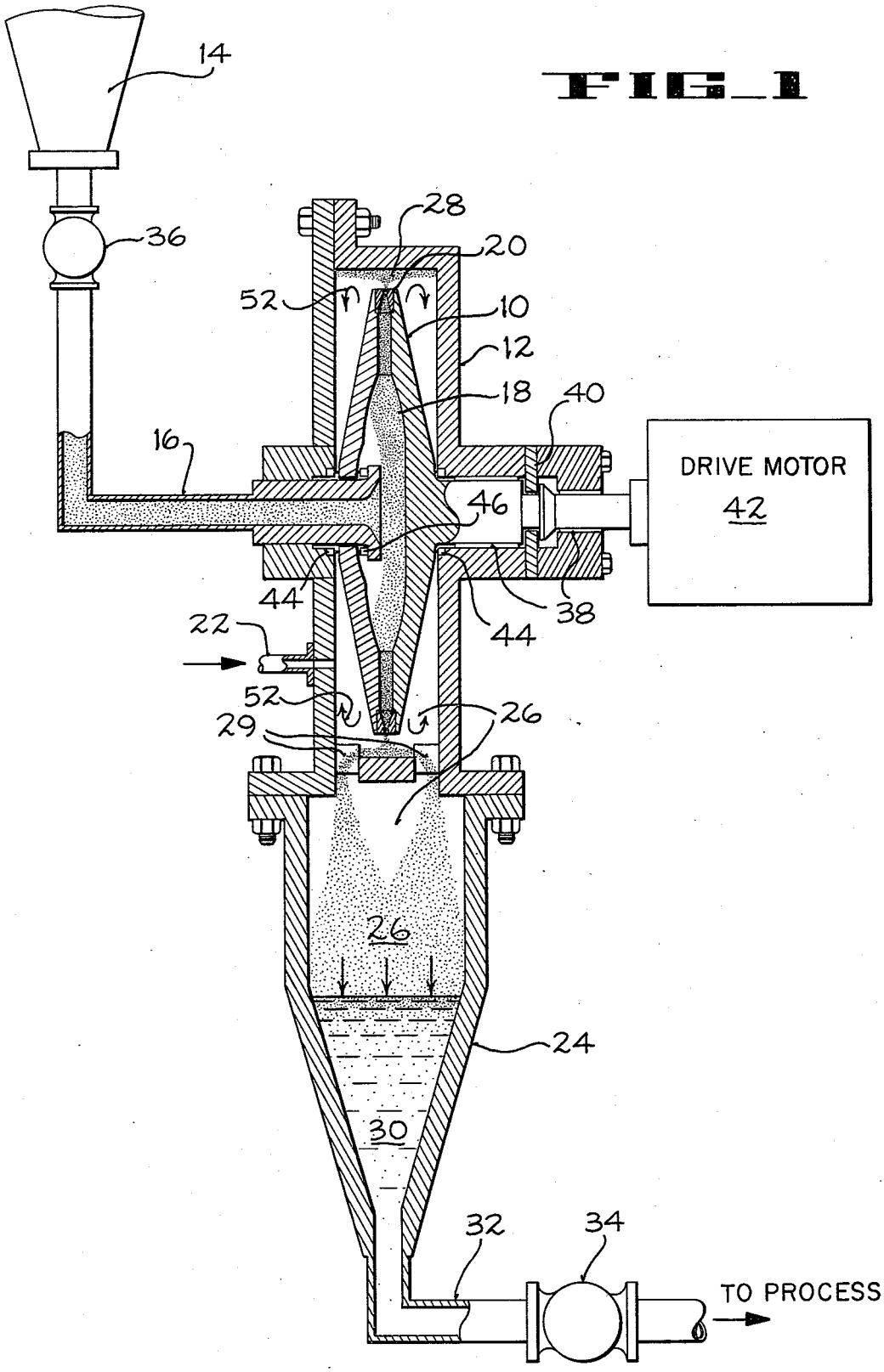
FIG. 1 is a partial vertical sectional view, with portions shown diagrammatically, of a slurry pumping system embodying this invention.

In FIG. 1, there is shown, for purposes of illustration, a partially schematic representation of a liquid slurry pressurizing system embodying the invention. In the illustrated embodiment, the slurry pump of our invention includes a rotor or impeller 10 positioned within the gas pressurized rotor casing 12. A slurry of solid particles in a liquid medium is fed to the impeller 10 from reservoir 14 via stationary suction pipe 16 into the eye of the impeller. The slurry thence enters a plurality of generally radial passages 18. The passages 18 may be exactly radial, or may be swept back with respect to the rotation of the rotor.

Positioned in the rim of rotor 10 at the distal ends of passages 18 are nozzles 20. These nozzles control the flow rate of the slurry through the pump and accelerate the slurry to a sufficient velocity for the flow to be stable with respect to upstream incursion of gas bubbles. The slurry is discharged from the rotor through the plurality of nozzles 20 into the casing 12 as a plurality of slurry jets. The particles and mist exiting the nozzles 20 are driven radially away from the rotor 20 and toward the inside of the casing 12 by centrifugal action and the vortices caused by the rotor rotation. Few particles strike the rotor surface. Compressed gas is supplied to the rotor casing 12 by any well-known means (not shown) and is introduced into rotor casing through port 22. The rotation of rotor 10 induces the compressed gas to swirl in the same direction as the rotor but at a reduced velocity. The effect of the injection of the compressed gas and the concentration of the particles near the casing is that the rotor runs in a gas bubble and the problem of erosion of the outside of the rotor is drastically reduced, thus allowing the rotor to be driven at substantially higher tip speeds. Rotor erosion is further mitigated by the fact that the rotor exterior is a bladeless body of revolution with no protuberances subject to wear.

The concentrated mist adjacent to the casing periphery 28 passes through connecting slots 29 into a demisting/setting vessel and slurry accumulator tank 24 mounted directly below the pump casing 12. At the bottom of tank 24 the settled slurry 30 is discharged to the reactor (not shown) via pipe 32. Normally open valves 34 and 36 are shown in the suction and discharge pipes. These valves are closed only during starting or stopping the slurry pump.

The rotor 10 is supported on shaft bearings 38 and thrust bearing 40 and driven by drive motor 42, or any other conventional drive means. The rotating seals 44 seal between the rotor and casing, rotating seal 46 seals between the suction pipe and the inside of the motor.

Figure 2:
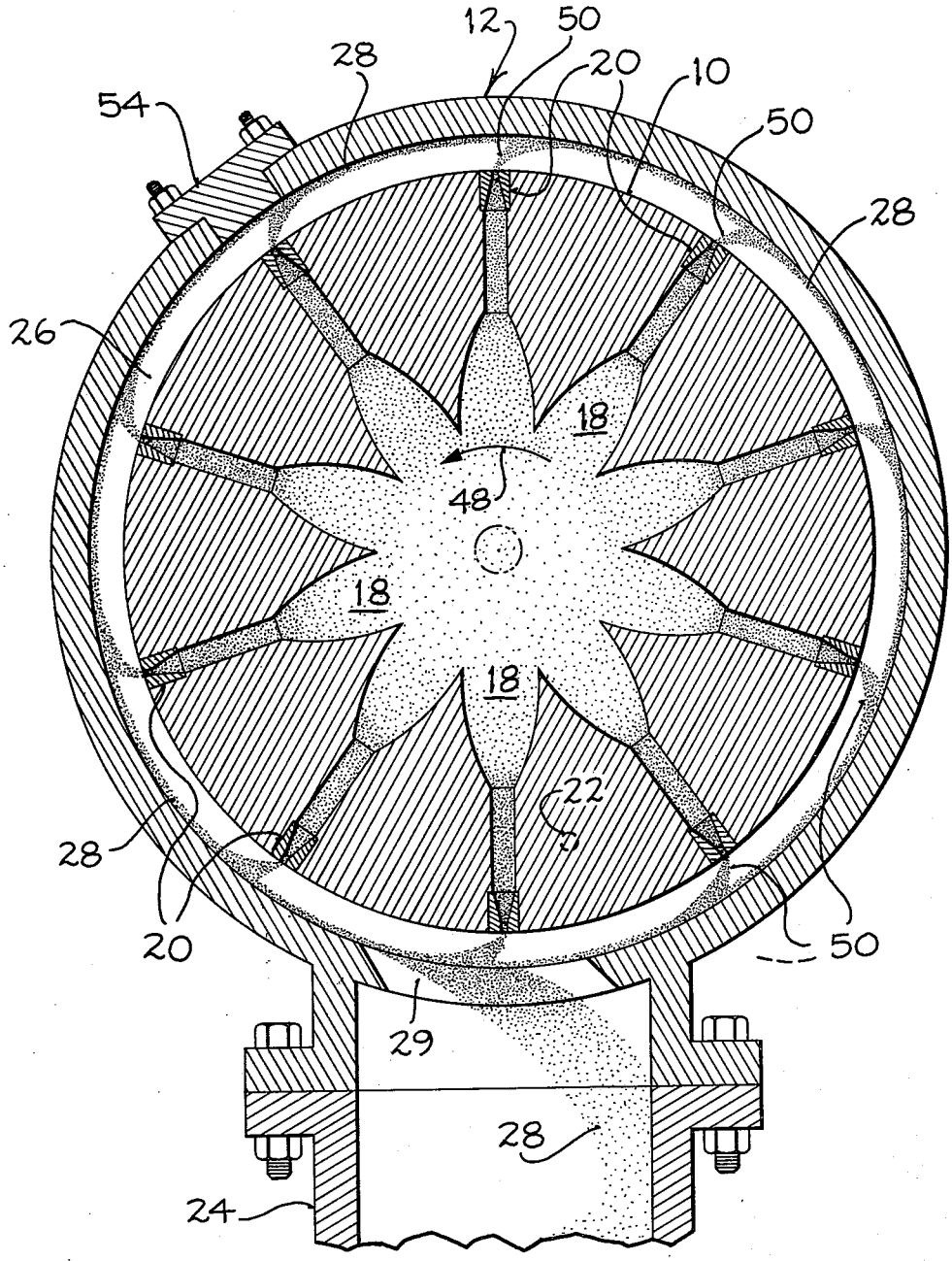
FIG. 2 is a partial vertical sectional view, with the section taken at 90° from the FIG. 1 section, slowing details of the impeller, the slurry mist flow in the casing exterior to the impeller, and the communication to the slurry collection vessel.

FIG. 2 shows a partly schematic section view of the embodiment of FIG. 1 with the section taken perpendicular to the axis of rotation of the machine. This view further illustrates the multiphase flow inside the rotor casing. The rotation direction, as indicated by arrow 48 is counter clockwise. As shown in FIG. 2, the nozzle slurry discharge jets 50 are broken up and decelerated by aerodynamic action upon entering the gas filled casing. Due to the combined effects of rotor and casing aerodynamic friction, as well as the slurry momentum, the gas bubble 26 surrounding the rotor 10 also rotates at a speed of 20%–40% of the angular velocity of the rotor itself. This sets up a very strong cyclone effect which causes the pumped slurry to concentrate in a relatively thin layer 28 which spins around the inside periphery of the casing. Discharge slots 29 position at the bottom of the casing allow the slurry from this layer to be discharged as a jet into the demisting vessel 24. The slots 29 are located in the casing corners (see FIG. 1) because secondary flow patterns denoted by arrows 52 (in FIG. 1) are set up in the casing which further concentrate the slurry mist in these corners.

Also shown in FIG. 2 is access port 54 for replacement of nozzles 20.

Figure 3:
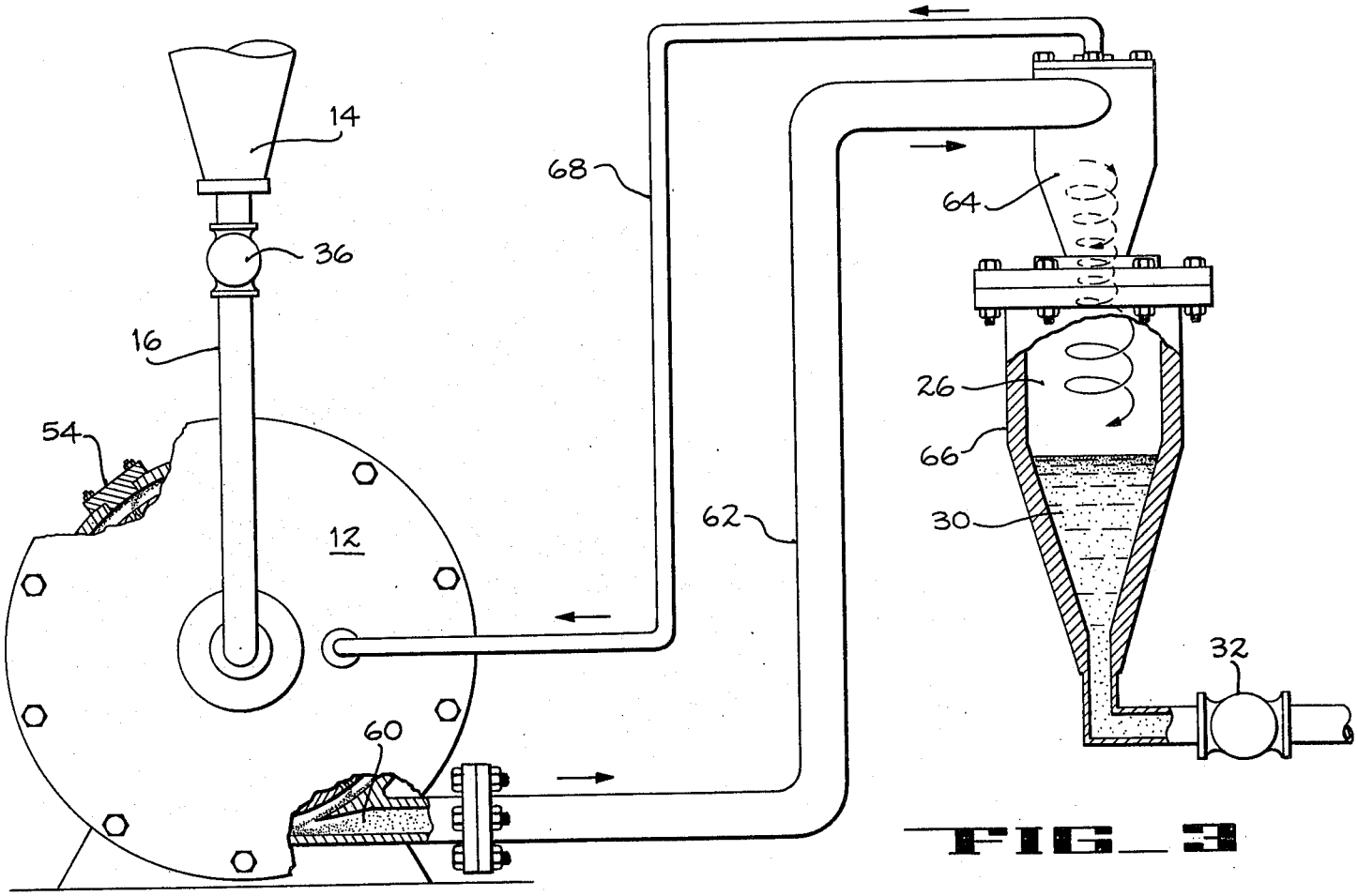
FIG. 3 is a schematic view of a second embodiment of slurry pumping system embodying this invention.

In FIG. 3 is shown a second embodiment of the slurry pumping system of the present invention. In this embodiment, the slurry mist layer is discharged from the casing 12 via tangential discharge 60 and conveyed through pipe 62 to cyclone separator 64 wherein the slurry is separted from the bubble gas and drains into slurry tank 66. The conveying gas is returned to the rotor casing 12 via gas return line 68. Circulation of the gas containing slurry mist through pipe 62, and the gas return via pipe 68, is driven by the fan action of the impeller 10.

Figures 4, 5:
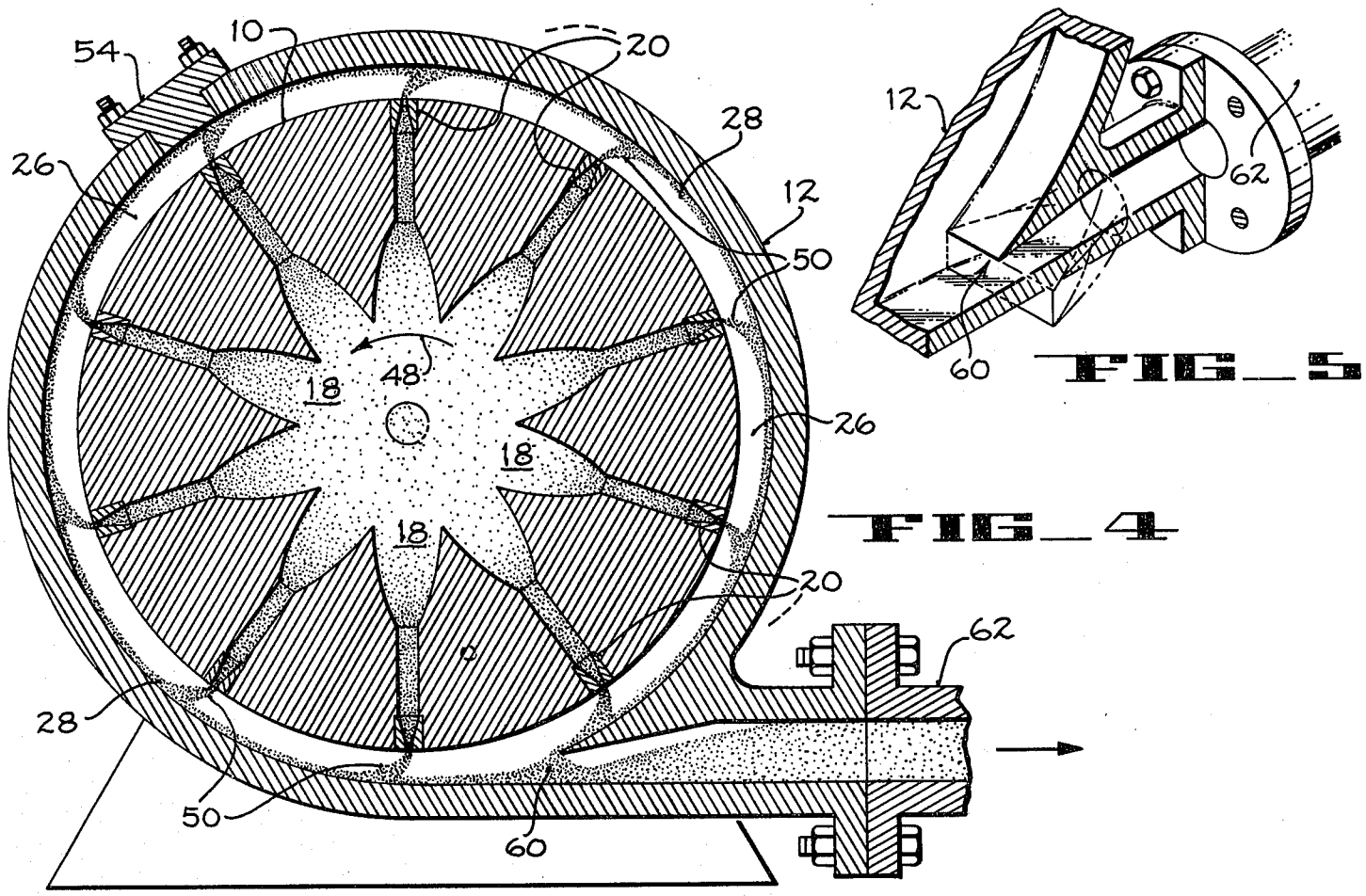
FIG. 4 is a partial sectional view showing details of the slurry pumping system of the FIG. 3 embodiment.
FIG. 5 shows further details of the slurry mist discharge opening for the FIG. 3 embodiment of the present invention.

FIG. 4 and FIG. 5 show cross section views of the FIG. 3 embodiment of the invention and illustrates slurry mist layer discharge port in detail. As shown, the slurry mist wall layer 28 is captured by a crosswise rectangular inlet duct 60 extending across the inside periphery of the casing 12. This rectangular duct expands in area and to a circular cross section to mate with pipe 62.

The ideal pressure rise P achievable by the pump is $$P=\tfrac{1}{2}DV^2$$

where D is the slurry density and V is the impeller tip speed. This is ½ the ideal pressure rise of an ordinary centrifugal pump, as given by the Euler equation. The difference is due to the intrinsic inability of the present invention to convert the kinetic energy of the fluid ejected from the rotor to further pressure rise, as takes place in the diffuser of a conventional pump. However, as stated previously, erosive effects limit tip speeds to only 120 ft/sec in conventional centrifugal slurry pumps. This limit does not apply to the present invention so much higher performance can be obtained. FIG. 6 shows a graph of the ideal pressure rise for a conventional pump and for the present invention, as a function of tip speed V. Curve 70 represents the ideal curve for the present invention and curve 72 that for a conventional slurry pump. The 120 ft/sec tip speed limit is denoted by point 74 which represents the maximum practical tip speed of the conventional pump due to erosive problems. The present invention can be operated at tip speeds in excess of 500 ft/sec. As can be seen in FIG. 6, such tip speed will allow a ten-fold increase in single stage pressure rise in comparison to a conventional centrifugal pump.

Under conditions of high tip speeds and high casing pressure, the power requirements for the present invention increase due to parasitic aerodynamic skin drag on the external surfaces of the rotor. The rotor runs in gas and the skin drag on the rotor is directly proportional to the density of the gas. Therefore, for high pressure applications, it is advantageous to use a low molecular weight gas such as Helium or Hydrogen in the gas bubble 26.

FIG. 7 shows a detail of the slurry flow passage 18 in the impeller 10, including the nozzle 20. The nozzle 20 is made as a small easily replaceable part.

The nozzle 20 must accelerate the slurry flow to a certain minimum outflow velocity, which is needed to make the flow stable against upstream incursion of gas bubbles. The algorithm showing the minimum nozzle outflow velocity is expressed as:

$$U_b=0.7(gd)^{\frac{1}{2}}G^{\frac{1}{4}}$$

where $U_b$=Bubble Rise Velocity d=channel or bubble diameter
g=1 g acceleration (32.2 ft/sec$^2$)
G=Centrifugal G-force in g's
taking as typical
nozzle outlet=d=0.01 ft
and
G=4000
we obtain from the above
$U_b$=25 ft/sec.
Thus, in this example, using a nozzle outflow velocity of 25 ft/sec or more produces a stable slurry flow through the pump.

In addition, the flow rate through the pump is mainly controlled by the pressure drop across the nozzle. The mass flow for the present invention is related to the slurry density, the tip flow speed of the rotor, the total nozzle area of the rotor and the casing pressure by the algorithm:

$$\dot{m} = DA\left(\frac{DV^2}{2} - P_c\right)^{\frac{1}{2}}$$

where:
$\dot{m}$=slurry mass flow through pump
D=slurry density
V=tip speed
A=total nozzle area
$P_c$=casing pressure It may be noted that the casing pressure $P_c$ is the pressure of the gas bubble which is established independently by any conventional gas pressurization system (not shown). The gas bubble pressure is not generated directly by the slurry pump. It may also be noted that the above is an ideal expression; to provide highly accurate predictions it must be modified in the normal manner by corrections for frictional pressure drops in the rotor passages and other non-idealities. However, for the present purpose of illustrating the principle of flow control, it is sufficient.

FIG. 8 shows characteristic pump curves computed from Eqn. 3 and with:
A=0.00102 ft$^2$ (12−$\frac{1}{8}$" nozzle outlet holes)
D=75 lbs/ft$^3$
V=300 ft/sec, 350 ft/sec, and 400 ft/sec Curve 76 represents the slurry pump performance with a tip speed of 400 ft/sec, curve 78 shows the performance with 350 ft/sec tip speed, and curve 80 is for 300 ft/sec. Direct control of the pump flow rate may be effected by variation of speed or by variation of casing gas bubble pressure, or a combination thereof. Finally, to obtain additional control flexibility, a throttling valve (not shown) may be placed in the line 32 between the slurry accumulator tank 24 and the reactor or process (not shown).

FIG. 9 shows a different embodiment of the slurry flow passage in the impeller 10 wherein the passage 18 and nozzle 20 is swept back at an angle with respect to the rotation direction. The sweep back tends to compensate for coriolis effects and prevents channeling of the slurry flow along one side of the passage.

The structure described herein is presently considered to be preferred; however, it is contemplated that further variations and modifications within the purview of those skilled in the art can be made herein. The following claims are intended to cover all such variations and modifications as fall within the true spirit and scope of the invention.

We claim:

1. A single stage high pressure centrifugal slurry pump for feeding a slurry to a high pressure environment comprising: a housing, an impeller rotatability mounted within said housing; said housing providing substantial clearance for the impeller; means for feeding a slurry consisting of finely divided solids suspended in a liquid to the center of said impeller; said impeller further including passages communicating from the center of said impeller to the periphery of said impeller whereby the rotation of said impeller drives the slurry from the center of said impeller through the passages to the interior of said housing; means for feeding compressed gas to the interior of said housing whereby the rotation of said impeller causes the slurry to be driven away from the impeller and the compressed gas to form a gas bubble immediately surrounding said impeller, said impeller passages further defined as terminating in convergent nozzles, said nozzles accelerating the slurry flow sufficiently to produce a velocity great enough to make the slurry flow stable against upstream incursion of gas bubbles from the area immediately surrounding said impeller into said passages.

2. The slurry pump of claim 1 wherein said compressed gas is of low molecular weight.

* * * * *